US009158235B1

(12) United States Patent
Tanaka

(10) Patent No.: US 9,158,235 B1
(45) Date of Patent: Oct. 13, 2015

(54) DEVELOPING APPARATUS AND IMAGE FORMING APPARATUS

(71) Applicant: Sharp Kabushiki Kaisha, Osaka-shi, Osaka (JP)

(72) Inventor: Tomomi Tanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/434,430

(22) PCT Filed: Sep. 20, 2013

(86) PCT No.: PCT/JP2013/075579

§ 371 (c)(1),
(2) Date: Apr. 9, 2015

(87) PCT Pub. No.: WO2014/057794

PCT Pub. Date: Apr. 17, 2014

(30) Foreign Application Priority Data

Oct. 11, 2012 (JP) ..... 2012-225977

(51) Int. Cl.
*G03G 15/08* (2006.01)

(52) U.S. Cl.
CPC ..... *G03G 15/0891* (2013.01)

(58) Field of Classification Search
CPC ..... G03G 15/0891; G03G 15/0822; G03G 15/0832; G03G 15/0839; G03G 2215/0827; G03G 2215/083; G03G 2215/0833; G03G 2215/0836
See application file for complete search history.

(56) References Cited

U.S. PATENT DOCUMENTS 4,725,206 A * 2/1988 Glaser et al. ..... 417/407
2001/0017997 A1* 8/2001 Saitoh ..... 399/250

FOREIGN PATENT DOCUMENTS

JP 2009-109741 A 5/2009
JP 2013125212 A * 6/2013

* cited by examiner

*Primary Examiner* — Clayton E Laballe
*Assistant Examiner* — Victor Verbitsky
(74) *Attorney, Agent, or Firm* — Keating & Bennett, LLP

(57) ABSTRACT

There is provided a developing apparatus which, when using a conveying member having a resin-made rotation shaft member, is capable of preventing fusion and adhesion of a toner in a vicinity of a bearing resulting from friction between the rotation shaft member and the bearing. A developing apparatus includes a developing tank; a first developer conveying section and a second developer conveying section; a first bearing and a second bearing; a first temperature rise suppression section and a second temperature rise suppression section which a have higher thermal conductivity than those of a first rotation shaft member and a second rotation shaft member as well as those of the first bearing and the second bearing; and a deflection suppression belt which is stretched out by the first temperature rise suppression section and the second temperature rise suppression section.

5 Claims, 8 Drawing Sheets

DEVELOPING APPARATUS AND IMAGE FORMING APPARATUS

TECHNICAL FIELD

The present invention relates to a developing apparatus and an image forming apparatus.

BACKGROUND ART

Conventionally, a developing apparatus which uses a two-component developer composed of a toner and a carrier and an image forming apparatus which forms an image by using the developing apparatus have been widely known. By stirring the two-component developer inside a developing tank, the developing apparatus generates friction between the toner and the carrier to thereby charge the toner. The charged toner is supplied to a surface of a developing roller and moved from the developing roller to an electrostatic latent image formed on a surface of a photoreceptor drum by electrostatic attraction force. Thereby, a toner image based on the electrostatic latent image is formed on the photoreceptor drum. This toner image is transferred and fixed onto a recording medium, so that an image is formed on the recording medium.

In recent years, speeding-up and miniaturization of the image forming apparatus are required, and accordingly it is necessary to perform charging of developer promptly and sufficiently as well as to perform conveyance of the developer promptly. As a technology therefor, in Patent Literature 1, proposed is a circulation type developing apparatus in which a partition wall is provided inside a developing tank, the developing tank is divided by this partition wall into a first developer conveying path and a second developer conveying path which extend along a longitudinal direction of the partition wall and are opposed to each other with the partition wall interposed therebetween and a first communication path and a second communication path with which the first developer conveying path and the second developer conveying path are communicated in both sides of the longitudinal direction of the partition wall, and a first auger screw and a second auger screw which are conveying members for conveying the developer are disposed in the first developer conveying path and in the second developer conveying path.

CITATION LIST

Patent Literature

Patent Literature 1: Japanese Unexamined Patent Publication JP-A 2009-109741

SUMMARY OF INVENTION

Technical Problem

The first auger screw and the second auger screw in the developing apparatus described in Patent Literature 1 are members that a columnar-shaped rotation shaft member is provided with a spiral blade surrounding a side surface of the rotation shaft member in a spiral manner. The rotation shaft member is supported by a bearing provided in the developing tank so as to be freely rotatable, and, in one end part of an axial direction of the rotation shaft member, a passive gear which engages with a driving gear connected to a rotation driving source inside an image forming apparatus is provided. By rotation of the driving gear by the rotation driving source, the rotation shaft member is rotated about an axis thereof together with the passive gear, resulting in that the developer is conveyed by the spiral blade provided in the rotation shaft member.

Due to easiness in manufacturing, an auger screw as described above is made of resin so that the spiral blade and the rotation shaft member are integrally molded, in many cases. However, in a case where the rotation shaft member is molded from resin, rigidity of the rotation shaft member is low, so that the rotation shaft member easily deflects in a direction in which the driving gear and the passive gear separate from each other when the auger screw rotates. When the rotation shaft member deflects, an excessive pressure is generated locally in a contact part of the rotation shaft member and the bearing, so that frictional heat generated by friction between the rotation shaft member and the bearing is increased, resulting in that uneven abrasion of the rotation shaft member easily occurs. When the uneven abrasion of the rotation shaft member proceeds, there are risks that a deflection amount of the rotation shaft member is increased, an even greater frictional heat is generated, temperature of a vicinity of the bearing is made high, and a toner is fused and adhered to the vicinity of the bearing. When the toner is fused and adhered to the vicinity of the bearing, a stirring property and a conveying property of the toner circularly conveyed by the auger screw are deteriorated.

The invention is for solving such a problem, and an object thereof is to provide a developing apparatus which, when using a conveying member having a resin-made rotation shaft member, is capable of preventing fusion and adhesion of a toner in a vicinity of a bearing resulting from friction between the rotation shaft member and the bearing, and an image forming apparatus including the developing apparatus.

Solution to Problem

The invention provides a developing apparatus which develops an electrostatic latent image formed on an image bearing member, comprising:

a developing tank having a wall part, the wall part defining an internal space for containing developer;

a plurality of developer conveying sections which are provided inside the developing tank and respectively have a rotation shaft member and a spiral blade fixed to the rotation shaft member which are made of a resin, the plurality of developer conveying sections respectively conveying developer contained inside the developing tank by rotating about an axis of the rotation shaft member;

a plurality of bearings which are provided in the wall part and respectively correspond to the plurality of developer conveying sections;

a plurality of temperature rise suppression sections which have a higher thermal conductivity than those of the rotation shaft members and the bearings, and respectively correspond to the plurality of developer conveying sections and the plurality of bearings, the plurality of temperature rise suppression sections being configured in a cylindrical shape, the respective rotation shaft members being inserted in the plurality of temperature rise suppression sections corresponding thereto, one part of each of the plurality of temperature rise suppression sections being interposed between the rotation shaft member corresponding thereto and the bearing corresponding thereto, and another part of each of the plurality of temperature rise suppression sections being disposed in a space outside the developing tank; and a deflection suppression belt being stretched out by the another part of each of the plurality of temperature rise suppression sections.

Further, in the developing apparatus of the invention, it is preferable that the deflection suppression belt has a fin.

Further, in the developing apparatus of the invention, it is preferable that the temperature rise suppression sections have a projection for suppressing positional displacement of the deflection suppression belt.

Further, the invention provides an image forming apparatus of an electrophotographic type, comprising:

the developing apparatus mentioned above.

Advantageous Effects of Invention

According to the invention, since the deflection suppression belt is stretched out by the plurality of temperature rise suppression sections provided in the plurality of developer conveying sections, deflection of the rotation shaft members is suppressed. Furthermore, since the temperature rise suppression sections have a higher thermal conductivity than those of the rotation shaft members and the bearings, heat in vicinities of the bearings moves to the temperature rise suppression sections. Accordingly, generation of great frictional heat due to uneven abrasion of the rotation shaft members is suppressed, and heat generated in the vicinities of the bearings is speedily radiated outside via the temperature rise suppression sections. Therefore, even when the developer conveying sections having the rotation shaft members which are made of a resin are provided, it is possible to prevent fusion and adhesion of a toner in the vicinities of the bearings, which result from friction of the rotation shaft members and the bearings.

Moreover, according to the invention, since the deflection suppression belt has a fin, it is possible to increase a surface area of the deflection suppression belt, so that it is possible to efficiently perform heat radiation by the deflection suppression belt.

Moreover, according to the invention, since the temperature rise suppression sections have a projection for suppressing positional displacement of the deflection suppression belt, it is possible to suppress deflection of the rotation shaft members more surely by the deflection suppression belt.

Moreover, according to the invention, since it is possible to prevent, by the developing apparatus, fusion and adhesion of a toner in the vicinities of the bearings, it is possible to prevent deterioration of a stirring property and a conveying property of the toner circularly conveyed by the developer conveying sections, making it possible to stably form a good image.

DESCRIPTION OF EMBODIMENTS

Description will hereinafter be given in detail for preferred embodiments of the invention with reference to drawings.

Figure 1:
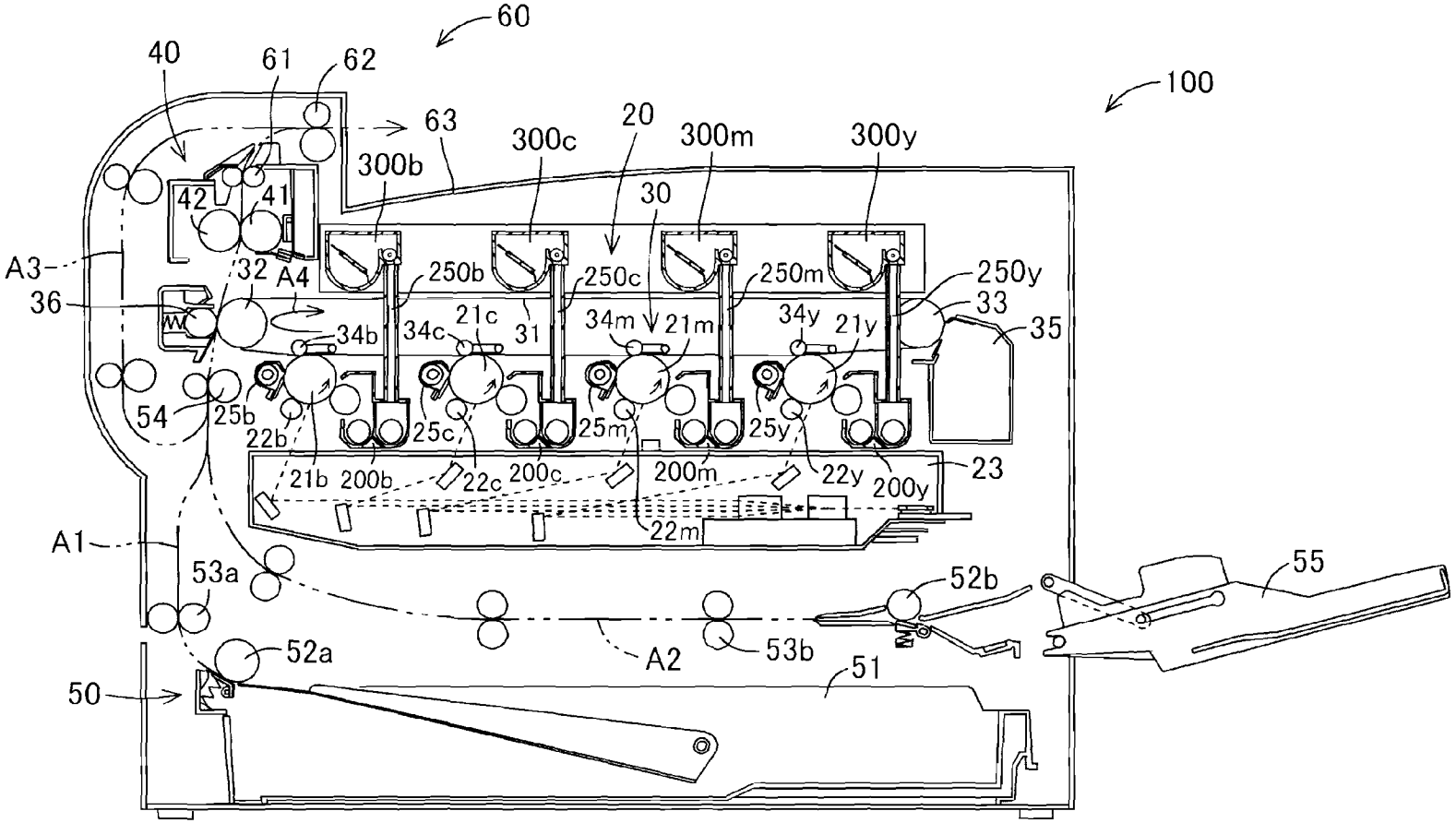
FIG. 1 is a schematic view showing the configuration of an image forming apparatus 100.

First, description will be given for an entire configuration of an image forming apparatus 100 including a developing apparatus 200 according to the invention. FIG. 1 is a schematic view showing the configuration of the image forming apparatus 100. The image forming apparatus 100 is a multifunctional peripheral which has a copying function, a printer function, and a facsimile function concurrently and forms a full color or monochrome image on a recording medium according to transmitted image information. The image forming apparatus 100 has three types of printing modes which are a copier mode (copying mode), a printer mode and a facsimile mode, and the printing modes are selected by a not-shown control unit section according to reception of operation input from a not-shown operation section or a printing job from a personal computer, a mobile terminal apparatus, an information recording medium, external equipment which uses a memory device or the like.

The image forming apparatus 100 includes a toner image forming section 20, a transfer section 30, a fixing section 40, a recording medium supply section 50, a discharge section 60, and the not-shown control unit section. The toner image forming section 20 includes photoreceptor drums 21*b*, 21*c*, 21*m* and 21*y*, charging sections 22*b*, 22*c*, 22*m* and 22*y*, an exposure unit 23, developing apparatuses 200*b*, 200*c*, 200*m* and 200*y*, cleaning units 25*b*, 25*c*, 25*m* and 25*y*, toner cartridges 300*b*, 300*c*, 300*m* and 300*y*, and toner supply pipes 250*b*, 250*c*, 250*m* and 250*y*. The transfer section 30 includes an intermediate transfer belt 31, a driving roller 32, a driven roller 33, intermediate transfer rollers 34*b*, 34*c*, 34*m* and 34*y*, a transfer belt cleaning unit 35 and a transfer roller 36.

The photoreceptor drums 21, the charging sections 22, the developing apparatuses 200, the cleaning units 25, the toner cartridges 300, the toner supply pipes 250 and the intermediate transfer rollers 34 are respectively provided in four sets so as to deal with image information of respective colors of black (b), cyan (c), magenta (m) and yellow (y) which are included in color image information. In this specification, in the case of distinguishing respective members which are provided in four sets in accordance with each color, an alphabet letter representing each color is added to the end of a numeral representing each of the members and this is used as a reference numeral, and in the case of referring respective members collectively, only a numeral representing each of the members serves as a reference sign.

The photoreceptor drum 21 is an image bearing member which is supported by a not-shown driving section so as to be rotatable about an axis thereof and which includes a conductive base and a photoconductive layer formed on a surface of the conductive base. The conductive base is able to employ various shapes, and a cylindrical shape, a columnar shape, a thin-film sheet shape and the like are able to be used, for example. The photoconductive layer is formed of a material which exhibits a conductive property when light is irradiated thereto. As the photoreceptor drum 21, for example, one that includes a cylindrical-shaped member formed of aluminum (conductive base) and a thin film which is formed on an outer circumferential surface of this cylindrical-shaped member and is composed of amorphous silicon (a-Si), selenium (Se) or an organic photoconductor (OPC) (photoconductive layer) is able to be used.

The charging section 22, the developing apparatus 200 and the cleaning unit 25 are arranged around a rotation direction of the photoreceptor drum 21 in this order, and the charging section 22 is arranged vertically lower than the developing apparatus 200 and the cleaning unit 25.

The charging section 22 is a device which charges a surface of the photoreceptor drum 21 to predetermined polarity and potential. The charging section 22 is installed in a position facing the photoreceptor drum 21 along a longitudinal direction of the photoreceptor drum 21. In the case of a contact charging type, the charging section 22 is installed so as to be in contact with the surface of the photoreceptor drum 21. In the case of a non-contact charging type, the charging section 22 is installed so as to be separated from the surface of the photoreceptor drum 21.

The charging section 22 is installed around the photoreceptor drum 21 together with the developing apparatus 200, the cleaning unit 25 and the like. It is preferable that the charging section 22 is installed in a position closer to the photoreceptor drum 21 than the developing apparatus 200, the cleaning unit 25 and the like. Thereby, it is possible to surely prevent occurrence of charging failure of the photoreceptor drum 21.

As the charging section 22, a brush type charging device, a roller type charging device, a corona discharge device, an ion generating device or the like is able to be used. The brush type charging device and the roller type charging device are the charging devices of the contact charging type. The brush type charging device includes one that uses a charging brush, one that uses a magnetic brush, and the like. The corona discharge device and the ion generating device are the charging devices of the non-contact charging type. The corona discharge device includes one that uses a wire-shaped discharge electrode, one that uses a pin array discharge electrode, one that uses a needle-shaped discharge electrode and the like.

The exposure unit 23 is arranged so that light emitted from the exposure unit 23 passes through between the charging section 22 and the developing apparatus 200 to be irradiated onto the surface of the photoreceptor drum 21. By respectively irradiating the surfaces of the photoreceptor drums 21*b*, 21*c*, 21*m* and 21*y* in a charged state with laser beam corresponding to the image information of respective colors, the exposure unit 23 forms electrostatic latent images corresponding to the image information of respective colors on the respective surfaces of the photoreceptor drums 21*b*, 21*c*, 21*m* and 21*y*. For the exposure unit 23, a laser scanning unit (LSU) provided with a laser irradiation section and a plurality of reflection mirrors is able to be used, for example. As the exposure unit 23, an LED (Light Emitting Diode) array, a unit in which a liquid crystal shutter and a light source are combined as appropriate or the like may be used.

The developing apparatus 200 is a device which forms a toner image on the photoreceptor drum 21 by developing the electrostatic latent image formed on the photoreceptor drum 21 with a toner. In a vertically upper part of the developing apparatus 200, the toner supply pipe 250 which is a tubular member is connected. Detailed description for the developing apparatus 200 will be given below.

The toner cartridge 300 is disposed vertically upper than the developing apparatus 200, and stores an unused toner. In a vertically lower part of the toner cartridge 300, the toner supply pipe 250 is connected. The toner cartridge 300 supplies the toner to the developing apparatus 200 via the toner supply pipe 250.

The cleaning unit 25 is a member which, after the toner image is transferred from the photoreceptor drum 21 onto the intermediate transfer belt 31, removes a residual toner on the surface of the photoreceptor drum 21 to clean the surface of the photoreceptor drum 21. As the cleaning unit 25, a plate-shaped member for scraping the toner and a container-shaped member for collecting the scraped toner are used, for example.

According to the toner image forming section 20, the surface of the photoreceptor drum 21 in a uniformly charged state by the charging section 22 is irradiated with the laser beam according to the image information from the exposure unit 23 to form an electrostatic latent image. By supplying the toner from the developing apparatus 200 to the electrostatic latent image on the photoreceptor drum 21, a toner image is formed. This toner image is transferred onto the intermediate transfer belt 31 described below. After the toner image is transferred onto the intermediate transfer belt 31, the residual toner on the surface of the photoreceptor drum 21 is removed by the cleaning unit 25.

The intermediate transfer belt 31 is an endless belt-shaped member arranged vertically above the photoreceptor drum 21. The intermediate transfer belt 31 is stretched out by the driving roller 32 and the driven roller 33 to form a loop-shaped route and moves in a direction of an arrow A4.

The driving roller 32 is provided so as to be rotatable about an axis thereof by a not-shown driving section. By the rotation thereof, the driving roller 32 moves the intermediate transfer belt 31 in the direction of the arrow A4. The driven roller 33 is provided so as to be rotatable by following the rotation of the driving roller 32, and generates constant tension to the intermediate transfer belt 31 so that the intermediate transfer belt 31 does not go slack.

The intermediate transfer roller 34 is in pressure-contact with the photoreceptor drum 21 via the intermediate transfer belt 31, and is provided so as to be rotatable about an axis thereof by a not-shown driving section. As the intermediate transfer roller 34, one that a conductive elastic member is formed on a surface of a metal (for example, stainless steel) roller having a diameter of 8 mm to 10 mm is able to be used, for example. The intermediate transfer roller 34 is connected to a not-shown power source which applies a transfer bias, and has a function of transferring the toner image on the surface of the photoreceptor drum 21 onto the intermediate transfer belt 31.

The transfer roller 36 is in pressure-contact with the driving roller 32 via the intermediate transfer belt 31, and is provided so as to be rotatable about an axis thereof by a not-shown driving section. In a pressure contact section (transfer nip section) between the transfer roller 36 and the driving roller 32, the toner image borne on and conveyed by the intermediate transfer belt 31 is transferred onto a recording medium fed from the recording medium supply section 50 described below.

The transfer belt cleaning unit 35 is provided opposite to the driven roller 33 via the intermediate transfer belt 31, and is provided so as to be in contact with a toner image bearing surface of the intermediate transfer belt 31. The transfer belt cleaning unit 35 is provided for removing and collecting the toner on a surface of the intermediate transfer belt 31 after the toner image is transferred onto the recording medium. When the toner remains on the intermediate transfer belt 31 with adhering thereto after the toner image is transferred onto the recording medium, there is a risk that a residual toner adheres to the transfer roller 36 due to movement of the intermediate transfer belt 31. In a case where the toner adheres to the transfer roller 36, the toner contaminates a backside of a recording medium for next transfer. The transfer belt cleaning unit 35 therefore removes and collects the toner on the surface of the intermediate transfer belt 31 after the toner image is transferred onto the recording medium.

According to the transfer section 30, when the intermediate transfer belt 31 moves while being in contact with the photoreceptor drum 21, a transfer bias having polarity opposite to charged polarity of a toner on the surface of the photoreceptor drum 21 is applied to the intermediate transfer roller 34, and the toner image formed on the surface of the photoreceptor drum 21 is transferred onto the intermediate transfer belt 31. Toner images of respective colors formed respectively on the photoreceptor drum 21*y*, the photoreceptor drum 21*m*, the photoreceptor drum 21*c* and the photoreceptor drum 21*b* are successively transferred and overlaid in this order onto the intermediate transfer belt 31, so that a full color toner image is formed. The toner image transferred onto the intermediate transfer belt 31 is conveyed to the transfer nip section by the movement of the intermediate transfer belt 31, and is transferred onto the recording medium in the transfer nip section. The recording medium onto which the toner image is transferred is conveyed to the fixing section 40 described below.

The recording medium supply section 50 includes a paper feeding box 51, pick-up rollers 52*a* and 52*b*, conveying rollers 53*a* and 53*b*, registration rollers 54 and a paper feeding tray 55. The paper feeding box 51 is provided in a vertically lower part of the image forming apparatus 100, and is a container-shaped member which accommodates recording mediums inside the image forming apparatus 100. The paper feeding tray 55 is provided in an exterior wall surface of the image forming apparatus 100, and is a tray-shaped member which accommodates recording mediums outside the image forming apparatus 100. As the recording medium, plain paper, color copy paper, a sheet for an overhead projector, a postcard and the like are cited.

The pick-up roller 52*a* is a member for taking out the recording medium accommodated in the paper feeding box 51 one by one to feed to a paper conveying path A1. The conveying rollers 53*a* are a pair of roller-shaped members which are provided so as to be in pressure-contact with each other, and convey the recording medium toward the registration rollers 54 in the paper conveying path A1. The pick-up roller 52*b* is a member for taking out the recording medium accommodated in the paper feeding tray 55 one by one to feed to a paper conveying path A2. The conveying rollers 53*b* are a pair of roller-shaped members which are provided so as to be in pressure-contact with each other, and convey the recording medium toward the registration rollers 54 in the paper conveying path A2.

The registration rollers 54 are a pair of roller-shaped members which are provided so as to be in pressure-contact with each other, and feed the recording medium fed from the conveying rollers 53*a* and 53*b* to the transfer nip section in synchronization with conveyance of the toner image borne on the intermediate transfer belt 31 to the transfer nip section.

According to the recording medium supply section 50, in synchronization with conveyance of the toner image borne on the intermediate transfer belt 31 to the transfer nip section, the recording medium is fed from the paper feeding box 51 or the paper feeding tray 55 to the transfer nip section, and the toner image is transferred onto this recording medium.

The fixing section 40 includes a heating roller 41 and a pressure roller 42. The heating roller 41 is controlled so as to have predetermined fixing temperature. The pressure roller 42 is a roller which is in pressure-contact with the heating roller 41. With the pressure roller 42, the heating roller 41 holds the recording medium therebetween while heating, so that the toner constituting the toner image is fused and fixed onto the recording medium. The recording medium to which the toner image has been fixed is conveyed to the discharge section 60.

The discharge section 60 includes conveying rollers 61, discharge rollers 62 and a discharge tray 63. The conveying rollers 61 are a pair of roller-shaped members which are provided vertically upper than the fixing section 40 so as to be in pressure-contact with each other. The conveying rollers 61 convey the recording medium to which an image has been fixed, toward the discharge rollers 62.

The discharge rollers 62 are a pair of roller-shaped members which are provided so as to be in pressure-contact with each other. In the case of single-side printing, the discharge rollers 62 discharge the recording medium on which printing of one side has been completed to the discharge tray 63. In the case of double-side printing, the discharge rollers 62 convey the recording medium on which printing of one side has been completed to the registration rollers 54 via a paper conveying path A3 and discharge the recording medium on which printing of both sides has been completed to the discharge tray 63. The discharge tray 63 is provided on a vertically upper surface of the image forming apparatus 100, and accommodates the recording medium to which an image has been fixed.

The image forming apparatus 100 includes the not-shown control unit section. The control unit section is provided, for example, in a vertically upper part in an internal space of the image forming apparatus 100, and includes a storage section, a computing section and a control section. In the storage section, various setting values via a not-shown operation panel arranged on the vertically upper surface of the image forming apparatus 100, a detection result from a not-shown sensor and the like arranged in each place inside the image forming apparatus 100, image information from external equipment, etc. are inputted. Moreover, in the storage section, a program for executing various processing is written. The various processing includes recording medium determination processing, adhesion amount control processing and fixation condition control processing, for example.

For the storage section, one that is commonly used in this field is able to be used, and a read only memory (ROM), a random access memory (RAM), a hard disk drive (HDD) and the like are cited, for example. For the external equipment, electric or electronic equipment which is capable of formation or acquisition of image information and is able to be electrically connected to the image forming apparatus 100 is able to be used, and a computer, a digital camera, television receiver, a video recorder, a DVD (Digital Versatile Disc) recorder, an HDDVD (High-Definition Digital Versatile Disc) recorder, a Blu-ray Disc recorder, a facsimile apparatus, a mobile terminal apparatus and the like are cited, for example.

The computing section takes out various data (an image formation instruction, a detection result, image information and the like) and a program of various processing which are written in the storage section for performing various determination. The control section sends a control signal to each device provided in the image forming apparatus 100 according to a determination result of the computing section for performing operation control.

The control section and the computing section include a processing circuit which is realized by a microcomputer, a microprocessor or the like with a central processing unit (CPU). The control unit section includes a main power source together with this processing circuit, and the power source supplies electric power not only to the control unit section but also to each device provided in the image forming apparatus 100.

Figure 2:
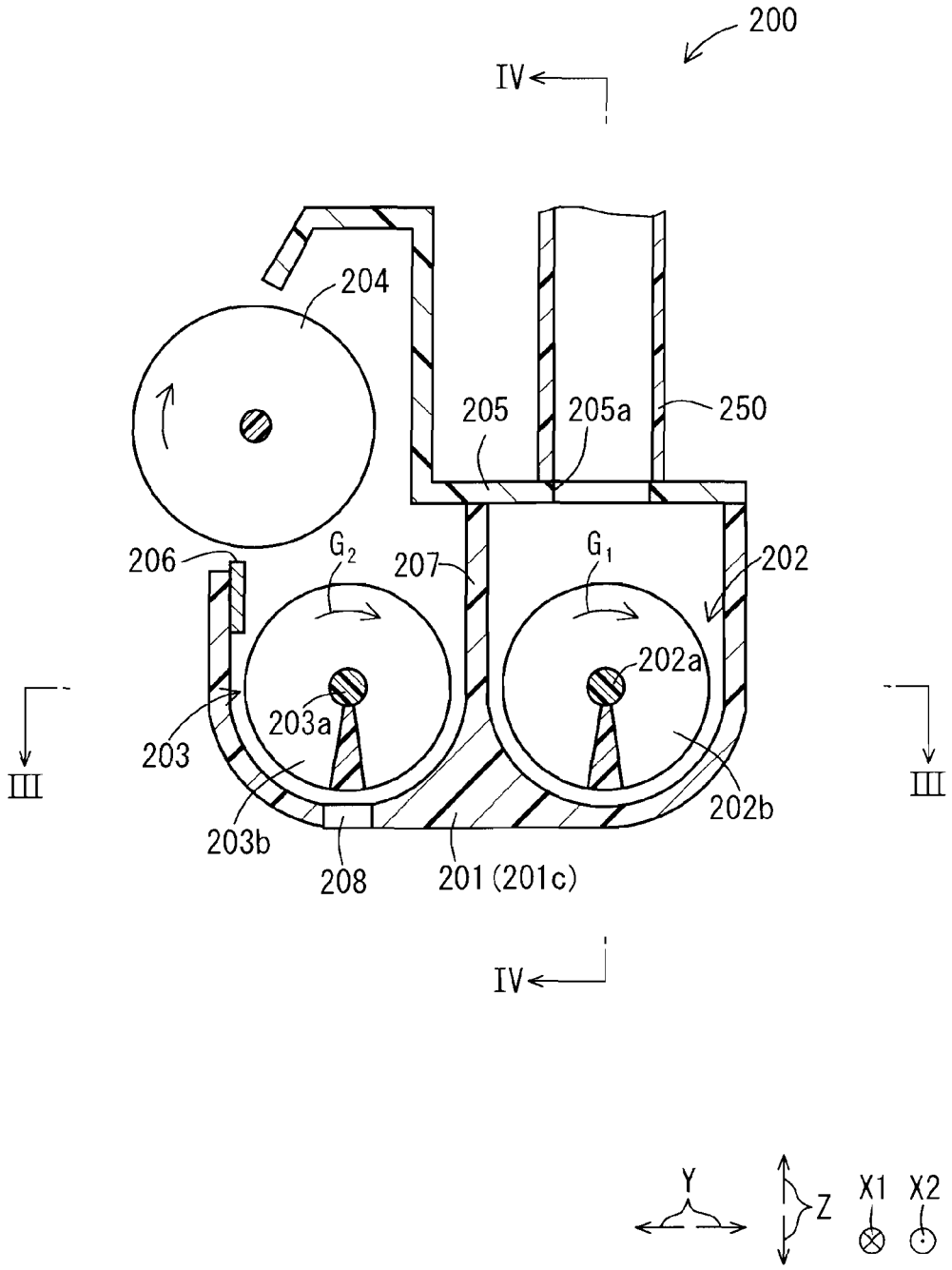
FIG. 2 is a schematic view showing the configuration of a developing apparatus 200.
Figure 3:
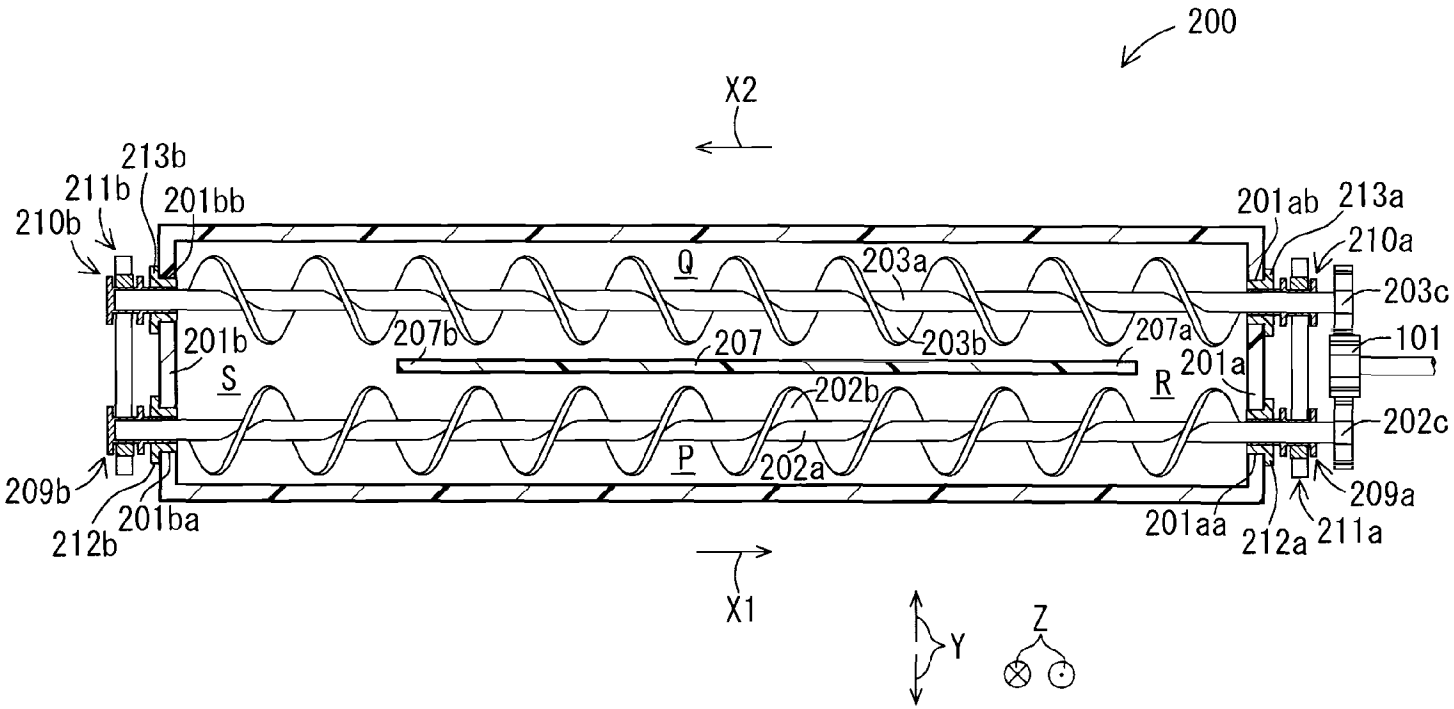
FIG. 3 is a cross sectional view of the developing apparatus 200 taken along the line III-III shown in FIG. 2.
Figure 4:
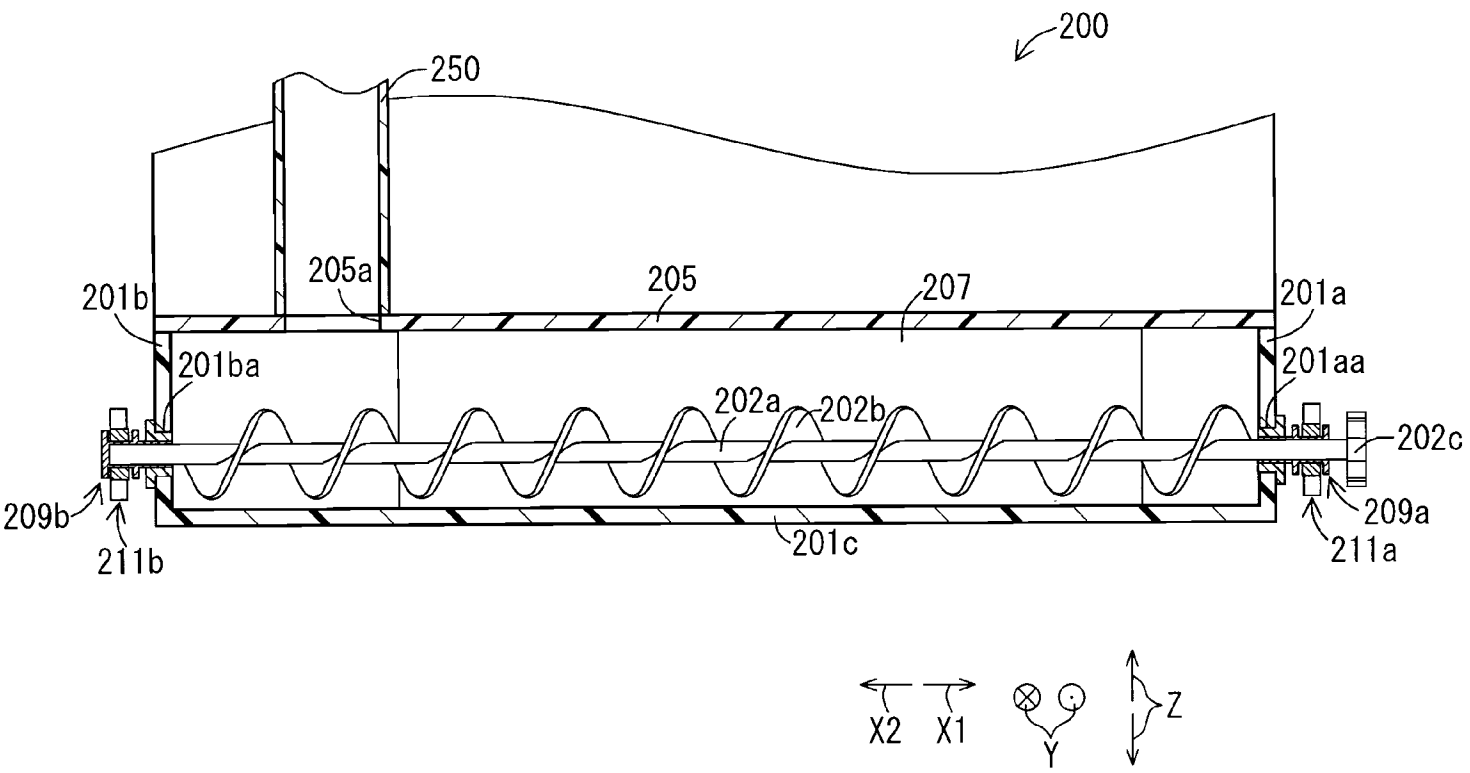
FIG. 4 is a cross sectional view of the developing apparatus 200 taken along the line IV-IV shown in FIG. 2.
Figure 5:
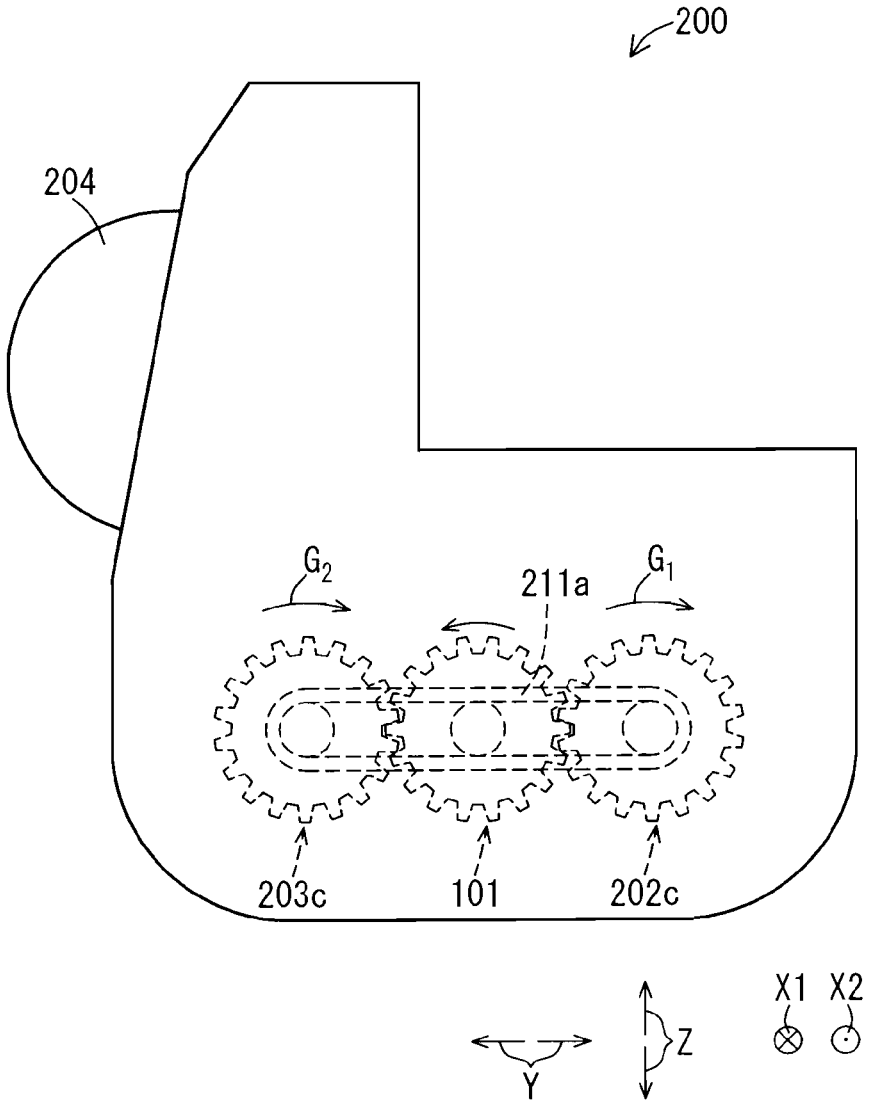
FIG. 5 is a side view of the developing apparatus 200.

Next, description will be given for a configuration of the developing apparatus 200 in detail. FIG. 2 is a schematic view showing the configuration of the developing apparatus 200. FIG. 3 is a cross sectional view of the developing apparatus 200 taken along the line III-III shown in FIG. 2. FIG. 4 is a cross sectional view of the developing apparatus 200 taken along the line IV-IV shown in FIG. 2. FIG. 5 is a side view of the developing apparatus 200.

The developing apparatus 200 is an apparatus which develops an electrostatic latent image formed on the surface of the photoreceptor drum 21 by supplying a toner to the surface of the photoreceptor drum 21. The developing apparatus 200 includes a developing tank 201, a first developer conveying section 202, a second developer conveying section 203, a developing roller 204, a developing tank cover 205, a doctor blade 206, a partition wall 207, a toner density detection sensor 208, first temperature rise suppression sections 209*a* and 209*b*, second temperature rise suppression sections 210*a* and 210*b*, and deflection suppression belts 211*a* and 211*b*. In the case of not distinguishing each of the first temperature rise suppression sections 209*a* and 209*b*, they are collectively referred to as the first temperature rise suppression section 209, in the case of not distinguishing each of the second temperature rise suppression sections 210*a* and 210*b*, they are collectively referred to as the second temperature rise suppression section 210, and in the case of not distinguishing each of the deflection suppression belts 211*a* and 211*b*, they are collectively referred to as the deflection suppression belt 211.

The developing tank 201 is a member in which an internal space is formed by side wall parts 201*a* and 201*b* and a bottom wall part 201*c*, and accommodates developer in the internal space. The developer used in the invention may be a one-component developer composed of only a toner and may be a two-component developer which contains a toner and a carrier. In the developing tank 201, the side wall parts 201*a* and 201*b* and the bottom wall part 201*c* may be integrally molded and may be separate members. The developing tank 201 is formed of a resin material, for example, such as polyethylene, polypropylene, high impact polystyrene and ABS resin (acrylonitrile-butadiene-styrene copolymer resin).

In the developing tank 201, the developing tank cover 205 is provided on a vertically upper side thereof, and in the internal space, the first developer conveying section 202, the second developer conveying section 203, the developing roller 204, the doctor blade 206 and the partition wall 207 are provided. Moreover, in a vertically lower part (bottom part) of the developing tank 201, the toner density detection sensor 208 is provided. Hereinafter, a direction in which the bottom part of the developing tank 201 is set as a lower side and the developing tank cover 205 serving as a ceiling part of the developing tank 201 is set as an upper side, is referred to as a first direction Z. In the developing apparatus 200, the first direction Z is a vertical direction.

In the developing tank 201, an opening part is provided between the photoreceptor drum 21 and the developing roller 204. The developing roller 204 includes a magnet roller, and bears the developer inside the developing tank 201 on a surface thereof to supply a toner contained in the borne developer to the photoreceptor drum 21. To the developing roller 204, a not-shown power source is connected and a developing bias voltage is applied. The toner borne on the developing roller 204 moves to the photoreceptor drum 21 by electrostatic force by the developing bias voltage in a vicinity of the photoreceptor drum 21.

The doctor blade 206 is a rectangular plate-shaped member extending in an axial direction of the developing roller 204, and is provided so that one end in a width direction thereof is fixed to the developing tank 201 and the other end has an interval with respect to the surface of the developing roller 204. The interval between the doctor blade 206 and the developing roller 204 (doctor gap) is, for example, 0.4 mm to 2.0 mm. By having the interval with respect to the surface of the developing roller 204, the doctor blade 206 regulates an amount of the developer borne on the developing roller 204 to a predetermined amount. As a material of the doctor blade 206, stainless steel, aluminum, synthetic resin and the like are cited.

The partition wall 207 is a member having a shape which extends along a longitudinal direction of the developing tank 201 in an approximately center part of a width direction of the developing tank 201. The partition wall 207 is provided so as to extend between the bottom wall part 201*c* of the developing tank 201 and the developing tank cover 205, and is provided so that both end parts in a longitudinal direction are separated from the side wall parts 201*a* and 201*b* of the developing tank 201. By the partition wall 207, the internal space of the developing tank 201 is divided into a first conveying path P, a second conveying path Q, a first communication path R and a second communication path S.

The second conveying path Q is a space having an approximately semi-columnar shape, which extends along the longitudinal direction of the partition wall 207, and is a space facing the developing roller 204. The first conveying path P is a space having an approximately semi-columnar shape, which extends along the longitudinal direction of the partition wall 207, and is a space opposite to the second conveying path Q with the partition wall 207 interposed therebetween. The first communication path R is a space by which the first conveying path P and the second conveying path Q are communicated on a side of one end part 207*a* in the longitudinal direction of the partition wall 207. The second communication path S is a space by which the first conveying path P and the second conveying path Q are communicated on a side of the other end part 207*b* in the longitudinal direction of the partition wall 207.

The developing tank cover 205 is provided vertically above the developing tank 201 so as to be detachable from the developing tank 201, and has a supply port section 205*a*. To the developing tank cover 205, the toner supply pipe 250 is connected at the supply port section 205*a*. The supply port section 205*a* is an opening part in which an opening for supplying a toner to the developing tank 201 is formed, and a toner contained in the toner cartridge 300 is supplied into the developing tank 201 through the toner supply pipe 250 and the opening.

The supply port section 205*a* is provided in a vicinity of the second communication path S vertically above the first conveying path P. More specifically, the supply port section 205*a* is provided so that the opening formed in the supply port section 205*a* faces the first conveying path P and is at a same position as the second communication path S in the longitudinal direction of the partition wall 207.

The first developer conveying section 202 is provided in the first conveying path P. The first developer conveying section 202 conveys the developer inside the developing tank 201 to make a flow from the side of the other end part 207*b* in the longitudinal direction toward the side of the one end part 207*a* in the longitudinal direction of the partition wall 207. Hereinafter, a conveyance direction of the developer by the first developer conveying section 202 is referred to as a second direction X1. The second direction X1 is a direction which perpendicularly crosses the first direction Z, and is also a direction from the second communication path S toward the first communication path R. Note that, a direction perpendicular to the first direction Z and the second direction X1 is referred to as a "third direction Y".

The first developer conveying section 202 is an auger screw-shaped member which includes a first rotation shaft member 202*a*, a first spiral blade 202*b* and a first gear 202*c*. The first rotation shaft member 202*a* is a columnar-shaped member having a diameter of 5 mm to 8 mm, which extends in the second direction X1 and an opposite direction thereto, and is connected to the first gear 202*c* provided outside the developing tank 201 in a downstream end of the second direction X1.

With respect to the first rotation shaft member 202*a*, a downstream end part in the second direction X1 is inserted into and fixed to a first rotary cylinder 2091*a* of the first temperature rise suppression section 209*a*, which is described below, and is inserted into a first bearing 212*a* which is a radial bearing fixed to the side wall part 201*a* of the developing tank 201 together with this first rotary cylinder 2091*a*. The downstream end of the second direction X1 of the first rotation shaft member 202*a* extends to an outside of the developing tank 201. Moreover, with respect to the first rotation shaft member 202*a*, an upstream end part in the second direction X1 is inserted into and fixed to a first rotary cylinder 2091*b* of the first temperature rise suppression section 209*b*, which is described below, and is inserted into a first bearing 212*b* which is a radial bearing fixed to the side wall part 201*b* of the developing tank 201 together with this first rotary cylinder 2091*b*. An upstream end in the second direction X1 of the first rotation shaft member 202*a* extends to the outside of the developing tank 201. In this manner, the first rotation shaft member 202*a* is supported so as to be rotatable about an axis thereof by the two first temperature rise suppression sections 209*a* and 209*b* and the two first bearings 212*a* and 212*b*. Description for the first temperature rise suppression sections 209*a* and 209*b* and the first bearings 212*a* and 212*b* will be given below in detail.

A part other than the downstream end part in the second direction X1 and the upstream end part in the second direction X1 of the first rotation shaft member 202*a* is provided in the first conveying path P. On a side surface of this part, the first spiral blade 202*b* which is a member having a shape surrounding this side surface in a spiral manner is fixed. An outer diameter of the first spiral blade 202*b* is, for example, 10 mm to 20 mm.

The first rotation shaft member 202*a*, the first spiral blade 202*b* and the first gear 202*c* are formed of a resin material, for example, such as polyethylene, polypropylene, high impact polystyrene, ABS resin and polyacetal. It is preferable that the first rotation shaft member 202*a* and the first spiral blade 202*b* are integrally molded from a same material.

As shown in FIG. 3, in such a first developer conveying section 202, a driving gear 101 connected to a rotation driving source such as a not-shown motor provided in the image forming apparatus 100, and the first gear 202*c* which is a passive gear are engaged with each other. The driving gear 101 is provided in a same position as those of the first gear 202*c* and a second gear 203*c* described below in the first direction Z and the second direction X1, and is provided between the first gear 202*c* and the second gear 203*c* in the third direction Y. The driving gear 101 and the first gear 202*c* are rotated by the rotation driving source, so that the first developer conveying section 202 is rotated about the axis of the first rotation shaft member 202*a* at 100 rpm to 300 rpm. At this time, the first spiral blade 202*b* performs rotation motion about the axis of the first rotation shaft member 202*a*. Specifically, the first spiral blade 202*b* performs a rotation motion in a rotation direction G1 where a part which is positioned at a top part in the first direction Z of the first spiral blade 202*b* moves away from the partition wall 207 and approaches the bottom wall part 201*c* of developing tank 201. As a result of such a rotation motion, the developer accommodated in the first conveying path P is conveyed to a downstream side in the second direction X1. As described above, since the supply port section 205*a* of the developing tank cover 205 is formed in the vicinity of the second communication path S vertically above the first conveying path P, an unused toner inside the toner cartridge 300 is first supplied to the first conveying path P, and is then conveyed to the downstream side in the second direction X1 of the first conveying path P by the first developer conveying section 202.

The second developer conveying section 203 is provided in the second conveying path Q. The second developer conveying section 203 conveys the developer inside the developing tank 201 to make a flow from the side of the one end part 207*a* in the longitudinal direction toward the side of the other end part 207*b* in the longitudinal direction of the partition wall 207. Hereinafter, a conveyance direction of the developer by the second developer conveying section 203 is referred to as a direction X2. The direction X2 is a direction opposite to the second direction X1, and is a direction from the first communication path R toward the second communication path S.

The second developer conveying section 203 is an auger screw-shaped member which includes a second rotation shaft member 203*a*, a second spiral blade 203*b* and the second gear 203*c*. The second rotation shaft member 203*a* is a columnar-shaped member having a diameter of 5 mm to 8 mm, which extends in the direction X2 and an opposite direction thereto, and is connected to the second gear 203*c* provided outside the developing tank 201 at an upstream end in the direction X2.

In the second rotation shaft member 203*a*, an upstream end part of the direction X2 is inserted into and fixed to a second rotary cylinder 2101*a* of the second temperature rise suppression section 210*a*, which is described below, and is inserted into a second bearing 213*a* which is a radial bearing fixed to the side wall part 201*a* of the developing tank 201 together with this second rotary cylinder 2101*a*. The upstream end in the direction X2 of the second rotation shaft member 203*a* extends to the outside of the developing tank 201. Moreover, in the second rotation shaft member 203*a*, a downstream end part of the direction X2 is inserted into and fixed to a second rotary cylinder 2101*b* of the second temperature rise suppression section 210*b*, which is described below, and is inserted into a second bearing 213*b* which is a radial bearing fixed to the side wall part 201*b* of the developing tank 201 together with this second rotary cylinder 2101*b*. A downstream end of the direction X2 of the second rotation shaft member 203*a* extends to the outside of the developing tank 201. In this manner, the second rotation shaft member 203*a* is supported so as to be rotatable about an axis thereof by the two second temperature rise suppression sections 210*a* and 210*b* and the two second bearings 213*a* and 213*b*. Description for the second temperature rise suppression sections 210*a* and 210*b* and the second bearings 213*a* and 213*b* will be given below in detail.

A part other than the upstream end part in the direction X2 and the downstream end part in the direction X2 of the second rotation shaft member 203*a* is provided in the second conveying path Q. On a side surface of this part, the second spiral blade 203*b* which is a member having a shape surrounding this side surface in a spiral manner is fixed. An outer diameter of the second spiral blade 203*b* is, for example, 10 mm to 20 mm.

The second rotation shaft member 203*a*, the second spiral blade 203*b* and the second gear 203*c* are formed of a resin material, for example, such as polyethylene, polypropylene, high impact polystyrene, ABS resin and polyacetal. It is preferable that the second rotation shaft member 203*a* and the second spiral blade 203*b* are integrally molded from a same material.

As shown in FIG. 3, in such a second developer conveying section 203, the driving gear 101 connected to the rotation driving source such as the not-shown motor provided in the image forming apparatus 100, and the second gear 203*c* which is a passive gear are engaged with each other, and the driving gear 101 and the second gear 203*c* are rotated by the rotation driving source, so that the second developer conveying section 203 is rotated about the axis of the second rotation shaft member 203*a* at 100 rpm to 300 rpm. At this time, the second spiral blade 203*b* performs rotation motion about the axis of the second rotation shaft member 203*a*. Specifically, the second spiral blade 203*b* performs the rotation motion in a rotation direction G2 where a part which is positioned at a top part in the first direction Z of the second spiral blade 203*b* moves away from the bottom wall part 201*c* of developing tank 201 and approaches the partition wall 207. As a result of such a rotation motion, the two-component developer accommodated in the second conveying path Q is conveyed to a downstream side in the direction X2.

The toner density detection sensor 208 is attached vertically below the second developer conveying section 203 in the bottom part of the developing tank 201, and is provided so that a sensor face is exposed to a center part of the second conveying path Q. The toner density detection sensor 208 is electrically connected to a not-shown toner density control section.

The toner density control section drives the toner cartridge 300 according to a toner density detection result detected by the toner density detection sensor 208, and performs control for supplying a toner into the developing tank 201. More specifically, the toner density control section judges whether or not the toner density detection result by the toner density detection sensor 208 is lower than a predetermined setting value, and, in the case of judging as being low, sends a control signal for driving the toner cartridge 300 to supply a toner into the developing tank 201.

To the toner density detection sensor 208, a not-shown power source is connected. The power source applies a driving voltage for driving the toner density detection sensor 208 and a control voltage for outputting the toner density detection result to the toner density control section to the toner density detection sensor 208. The application of the voltages to the toner density detection sensor 208 by the power source is controlled by a not-shown control section of the image forming apparatus 100.

As the toner density detection sensor 208, a general toner density detection sensor is able to be used, and, for example, a transmission light detection sensor, a reflection light detection sensor, a magnetic permeability detection sensor or the like is able to be used. Among these toner density detection sensors, it is preferable to use the magnetic permeability detection sensor. As the magnetic permeability detection sensor, TS-L (trade name, manufactured by TDK Corporation), TS-A (trade name, manufactured by TDK Corporation), TS-K (trade name, manufactured by TDK Corporation) and the like are cited, for example.

Figure 6:
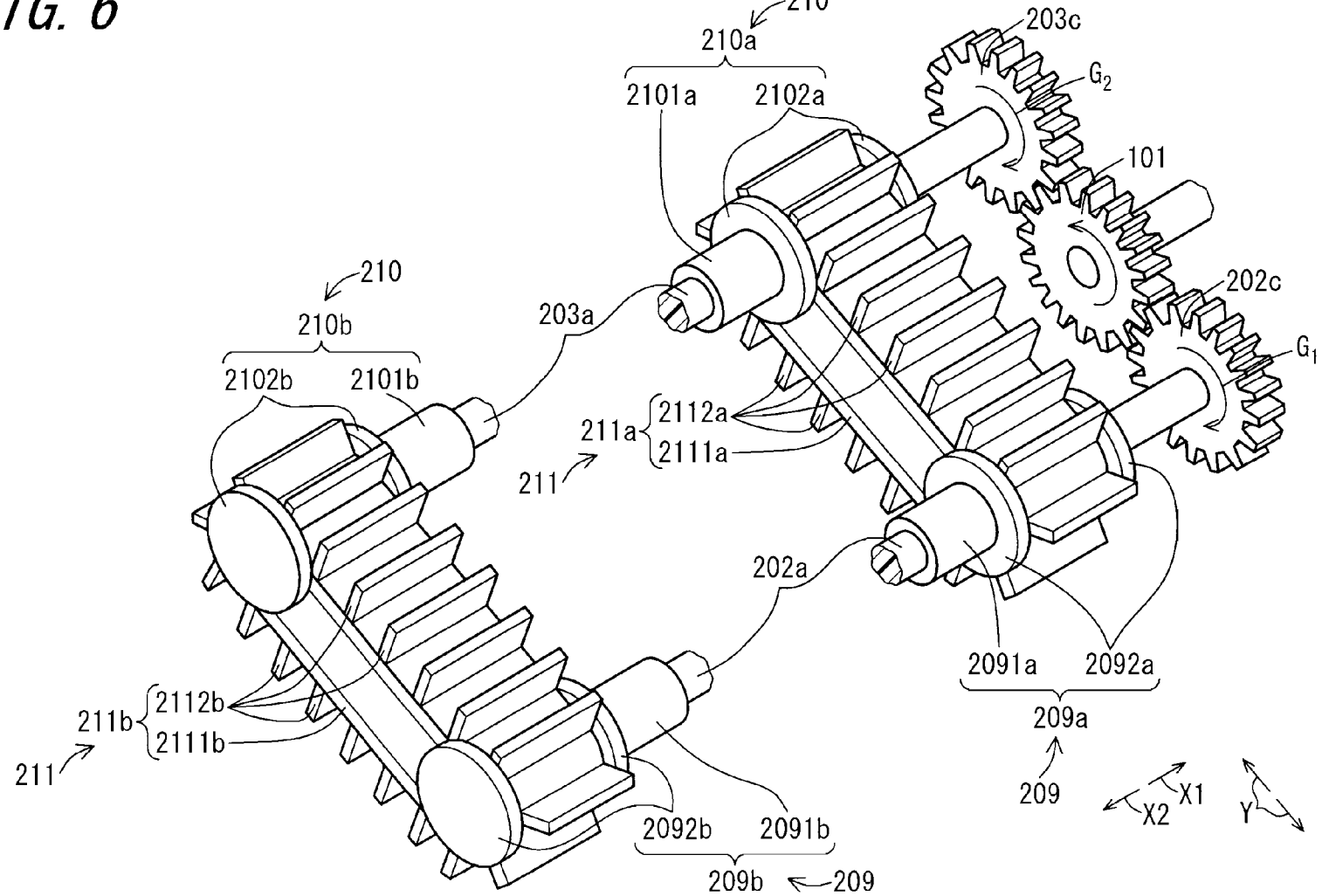
FIG. 6 is a perspective view of a first temperature rise suppression section 209 and a second temperature rise suppression section 210 as well as a deflection suppression belt 211.
Figure 7:
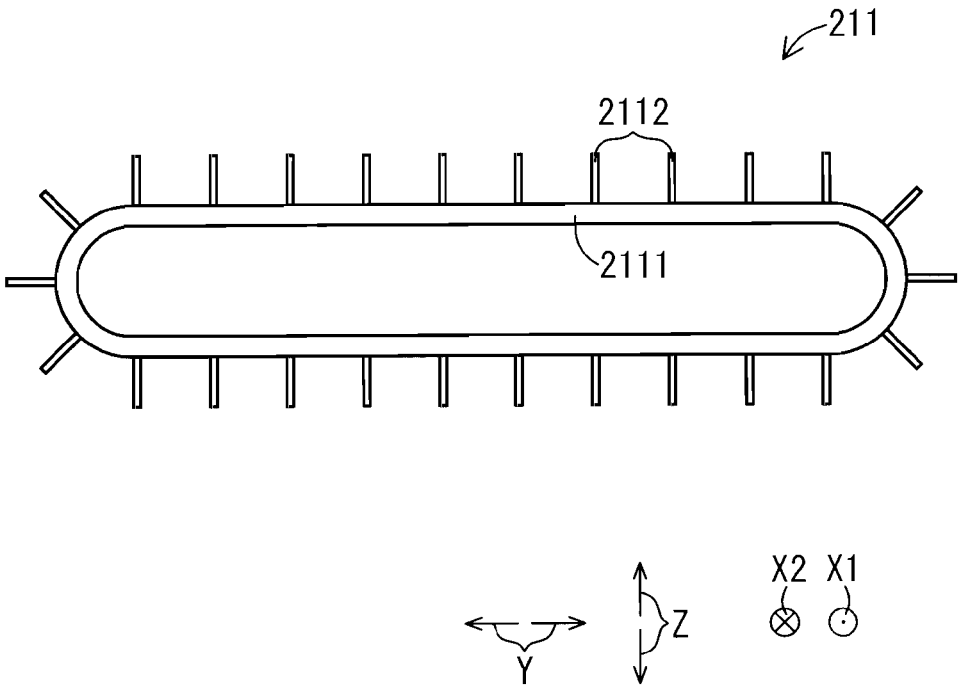
FIG. 7 is a front view of the deflection suppression belt 211.

FIG. 6 is a perspective view of the first temperature rise suppression section 209 and the second temperature rise suppression section 210 as well as the deflection suppression belt 211. FIG. 7 is a front view of the deflection suppression belt 211. The first temperature rise suppression section 209*a* has the first rotary cylinder 2091*a* which is supported by the first bearing 212*a* so as to be rotatable, and the first temperature rise suppression section 209*b* has the first rotary cylinder 2091*b* which is supported by the first bearing 212*b* so as to be rotatable. The second temperature rise suppression section 210*a* has the second rotary cylinder 2101*a* which is supported by the second bearing 213*a* so as to be rotatable, and the second temperature rise suppression section 210*b* has the second rotary cylinder 2101*b* which is supported by the second bearing 213*b* so as to be rotatable. The deflection suppression belt 211*a* is stretched out by the first rotary cylinder 2091*a* and the second rotary cylinder 2101*a*, and the deflection suppression belt 211*b* is stretched out by the first rotary cylinder 2091*b* and the second rotary cylinder 2101*b*.

As shown in FIG. 3, the first bearing 212*a* is an approximately cylindrically-shaped member provided in a hole part 201*aa* which is formed in the side wall part 201*a* of the developing tank 201, and the first bearing 212*b* is an approximately cylindrically-shaped member provided in a hole part 201*ba* which is formed in the side wall part 201*b* of the developing tank 201. The first bearings 212*a* and 212*b* are sliding bearings which are formed of a resin material having low frictional resistance (for example, resin material such as polyethylene, polypropylene, high impact polystyrene and ABS resin in or to which silicone oil is impregnated or applied).

Moreover, as shown in FIG. 3, the second bearing 213*a* is an approximately cylindrically-shaped member provided in a hole part 201*ab* which is formed in the side wall part 201*a* of the developing tank 201, and the second bearing 213*b* is an approximately cylindrically-shaped member provided in a hole part 201*bb* which is formed in the side wall part 201*b* of the developing tank 201. The second bearings 213*a* and 213*b* are sliding bearings which are formed of a resin material having low frictional resistance (for example, resin material such as polyethylene, polypropylene, high impact polystyrene and ABS resin in or to which silicone oil is impregnated or applied).

The first rotary cylinders 2091*a* and 2091*b* shown in FIG. 6 are cylindrically-shaped members which extend in an axial direction of the first rotation shaft member 202*a*, and cylindrically-shaped members which have inner diameters the same as or slightly larger than the diameter of the first rotation shaft member 202*a* and outer diameters the same as or slightly smaller than inner diameters of the first bearings 212*a* and 212*b*. The first rotary cylinders 2091*a* and 2091*b* where the end parts of the first rotation shaft member 202*a* are inserted and fixed are supported by the first bearings 212*a* and 212*b* together with the first rotation shaft member 202*a*. Since the first rotary cylinders 2091*a* and 2091*b* are fixed to the first rotation shaft member 202*a*, the first rotary cylinders 2091*a* and 2091*b* rotate about the axis of the first rotation shaft member 202*a* in conjunction with rotation of the first rotation shaft member 202*a*.

The first rotary cylinder 2091*a* is formed of a material which has a higher thermal conductivity than those of the first rotation shaft member 202*a* and the first bearing 212*a* at in-apparatus temperature of the image forming apparatus 100 and a little higher temperature than the in-apparatus temperature (hereinafter, simply referred to as "thermal conductivity"). The first rotary cylinder 2091*b* is formed of a material which has a higher thermal conductivity than those of the first rotation shaft member 202*a* and the first bearing 212*b*. As described above, since the first rotation shaft member 202*a* and the first bearings 212*a* and 212*b* in the developing apparatus 200 are formed of a resin material such as polyethylene, polypropylene, high impact polystyrene and ABS resin, the first rotary cylinders 2091*a* and 2091*b* are formed of a material which has a higher thermal conductivity than those of these resin materials. For example, the first rotary cylinders 2091*a* and 2091*b* may be formed of a material which has metallic powder having a high thermal conductivity such as aluminum, copper or stainless steel dispersed in these resin materials, may be formed of a metal such as aluminum, copper or stainless steel, and may be formed of an alloy containing these metals. In the developing apparatus 200, the first rotary cylinders 2091*a* and 2091*b* are formed of stainless steel.

The first rotary cylinders 2091*a* and 2091*b* are provided so as to extend from an internal wall surface of the developing tank 201 to a space outside the developing tank 201, and the first rotary cylinders 2091*a* and 2091*b* are partially exposed to the space outside the developing tank 201. More specifically, the first rotary cylinder 2091*a* has an end part in the direction X2 interposed between the first rotation shaft member 202*a* and the first bearing 212*a*, and has an end part in the second direction X1 exposed to the space outside the developing tank 201. In addition, the first rotary cylinder 2091*b* has an end part in the second direction X1 interposed between the first rotation shaft member 202*a* and the first bearing 212*b*, and has an end part in the direction X2 exposed to the space outside the developing tank 201.

In a part of the first rotary cylinder 2091*a* which part is exposed to the space outside the developing tank 201, the first temperature rise suppression section 209*a* has two disk-shaped projections 2092*a* for suppressing positional displacement of the deflection suppression belt 211*a* stretched out at the part. Moreover, in a part of the first rotary cylinder 2091*b* which part is exposed to the space outside the developing tank 201, the first temperature rise suppression section 209*b* has two disk-shaped projections 2092*b* for suppressing positional displacement of the deflection suppression belt 211*b* stretched out at the part. It is preferable that the disk-shaped projections 2092*a* are integrally molded with the first rotary cylinder 2091*a*, and it is preferable that the disk-shaped projections 2092*b* are integrally molded with the first rotary cylinder 2091*b*.

The second rotary cylinders 2101*a* and 2101*b* are cylindrically-shaped members which extend in an axial direction of the second rotation shaft member 203*a* and which have inner diameters the same as or slightly larger than the diameter of the second rotation shaft member 203*a* and outer diameters the same as or slightly smaller than inner diameters of the second bearings 213*a* and 213*b*. The second rotary cylinders 2101*a* and 2101*b* where the end parts of the second rotation shaft member 203*a* are inserted and fixed are supported by the second bearings 213*a* and 213*b* together with the second rotation shaft member 203*a*. Since the second rotary cylinders 2101*a* and 2101*b* are fixed to the second rotation shaft member 203*a*, the second rotary cylinders 2101*a* and 2101*b* rotate about the axis of the second rotation shaft member 203*a* in conjunction with rotation of the second rotation shaft member 203*a*.

The second rotary cylinder 2101*a* is formed of a material which has a higher thermal conductivity than those of the second rotation shaft member 203*a* and the second bearing 213*a*. The second rotary cylinder 2101*b* is formed of a material which has a higher thermal conductivity than those of the second rotation shaft member 203*a* and the second bearing 213*b*. As described above, since the second rotation shaft member 203*a* and the second bearings 213*a* and 213*b* in the developing apparatus 200 are formed of a resin material such as polyethylene, polypropylene, high impact polystyrene and ABS resin, the second rotary cylinders 2101*a* and 2101*b* are formed of a material which has a higher thermal conductivity than those of these resin materials. For example, the second rotary cylinders 2101*a* and 2101*b* may be formed of a material which has metallic powder having a high thermal conductivity such as aluminum, copper or stainless steel dispersed in these resin materials, may be formed of a metal such as aluminum, copper or stainless steel, and may be formed of an alloy containing these metals. In the developing apparatus 200, the second rotary cylinders 2101*a* and 2101*b* are formed of stainless steel.

The second rotary cylinders 2101*a* and 2101*b* are provided so as to extend from the internal wall surface of the developing tank 201 to the space outside the developing tank 201, and the second rotary cylinders 2101*a* and 2101*b* are partially exposed to the space outside the developing tank 201. More specifically, the second rotary cylinder 2101*a* has an end part in the direction X2 interposed between the second rotation shaft member 203*a* and the second bearing 213*a*, and has an end part in the second direction X1 exposed to the space outside the developing tank 201. In addition, the second rotary cylinder 2101*b* has an end part in the second direction X1 interposed between the second rotation shaft member 203*a* and the second bearing 213*b*, and has an end part in the direction X2 exposed to the space outside the developing tank 201.

In a part of the second rotary cylinder 2101*a* which part is exposed to the space outside the developing tank 201, the second temperature rise suppression section 210*a* has two disk-shaped projections 2102*a* for suppressing positional displacement of the deflection suppression belt 211*a* stretched out at the part. Moreover, in a part of the second rotary cylinder 2101*b* which part is exposed to the space outside the developing tank 201, the second temperature rise suppression section 210*b* has two disk-shaped projections 2102*b* for suppressing positional displacement of the deflection suppression belt 211*b* stretched out at the part. It is preferable that the disk-shaped projections 2102*a* are integrally molded with the second rotary cylinder 2101*a*, and it is preferable that the disk-shaped projections 2102*b* are integrally molded with the second rotary cylinder 2101*b*.

The deflection suppression belt 211 shown in FIG. 6 and FIG. 7 has a belt main body 2111 which is an endless belt-shaped member in which the second direction X1 and the opposite direction thereto (direction X2) is defined as a width direction, and a plurality of fins 2112 provided on an outer peripheral surface of the belt main body 2111. The deflection suppression belt 211*a* has a belt main body 2111*a* and fins 2112*a*, and the deflection suppression belt 211*b* has a belt main body 2111*b* and fins 2112*b*.

The deflection suppression belt 211*a* is a member for restraining the first rotation shaft member 202*a* and the second rotation shaft member 203*a* from being deflected by a fact that the first gear 202*c* and the second gear 203*c* seek to move away from the driving gear 101 when the driving gear 101 rotates, and is stretched out by the first temperature rise suppression section 209*a* fixed to the first rotation shaft member 202*a* and the second temperature rise suppression section 210*a* fixed to the second rotation shaft member 203*a* so that a distance between the first rotation shaft member 202*a* and the second rotation shaft member 203*a* is kept constant. The deflection suppression belt 211*b* is a member for restraining the first rotation shaft member 202*a* and the second rotation shaft member 203*a* from being deflected by a fact that the first gear 202*c* and the second gear 203*c* seek to move away from the driving gear 101 when the driving gear 101 rotates, and is stretched out by the first temperature rise suppression section

209*b* fixed to the first rotation shaft member 202*a* and the second temperature rise suppression section 210*b* fixed to the second rotation shaft member 203*a* so that the distance between the first rotation shaft member 202*a* and the second rotation shaft member 203*a* is kept constant.

The positional displacement of the belt main bodies 2111*a* and 2111*b* when the driving gear 101 rotates is suppressed by the disk-shaped projections 2092*a*, 2092*b*, 2102*a* and 2102*b*. More specifically, the disk-shaped projections 2092*a* which project from a side surface of the first rotary cylinder 2091*a* so as to sandwich both ends of the width direction of the belt main body 2111*a* on the first rotary cylinder 2091*a* and the disk-shaped projections 2102*a* which project from a side surface of the second rotary cylinder 2101*a* so as to sandwich the both ends of the width direction of the belt main body 2111*a* on the second rotary cylinder 2101*a* suppress meandering of the belt main body 2111*a* when the driving gear 101 rotates. In addition, the disk-shaped projections 2092*b* which project from a side surface of the first rotary cylinder 2091*b* so as to sandwich both ends of the width direction of the belt main body 2111*b* on the first rotary cylinder 2091*b* and the disk-shaped projections 2102*b* which project from a side surface of the second rotary cylinder 2101*b* so as to sandwich the both ends of the width direction of the belt main body 2111*b* on the second rotary cylinder 2101*b* suppress meandering of the belt main body 2111*b* when the driving gear 101 rotates.

The fins 2112 are for radiating heat of the belt main body 2111. The respective fins 2112 are, for example, a rectangular plate-shaped member, and are provided at equal intervals on the outer peripheral surface of the belt main body 2111. The number of the fins 2112 provided on the belt main body 2111 is able to be set as appropriate. It is preferable that the fins 2112 are integrally molded with the belt main body 2111.

The belt main body 2111*a* and the fins 2112*a* are formed of a material which has a higher thermal conductivity than those of the first rotary cylinder 2091*a* and the second rotary cylinder 2101*a*. The belt main body 2111*b* and the fins 2112*b* are formed of a material which has a higher thermal conductivity than those of the first rotary cylinder 2091*b* and the second rotary cylinder 2101*b*. As described above, since the first rotary cylinders 2091*a* and 2091*b* and the second rotary cylinders 2101*a* and 2101*b* in the developing apparatus 200 are formed of stainless steel, the belt main body 2111 and the fins 2112 are formed of a material which has a higher thermal conductivity than that of stainless steel. For example, the belt main body 2111 and the fins 2112 are formed of a metal such as aluminum or copper, which has a higher thermal conductivity than that of stainless steel. In the developing apparatus 200, the belt main body 2111 and the fins 2112 are formed of copper.

A thickness of the belt main body 2111 and a thickness of the fins 2112 are able to be set as appropriate according to a material. For example, the thickness of the belt main body 2111 formed of copper is 50 μm to 100 μm, and the thickness of the fins 2112 formed of copper is 50 μm to 100 μm.

According to the developing apparatus 200 provided with such a configuration, by rotation of the driving gear 101, the first developer conveying section 202 and the second developer conveying section 203 rotate, and the developer inside the developing tank 201 is thereby circularly conveyed in an order of the first conveying path P, the first communication path R, the second conveying path Q and the second communication path S. A part of the developer circularly conveyed is borne on the surface of the developing roller 204 in the second conveying path Q, and a toner in the borne developer moves to the photoreceptor drum 21 to be successively consumed, so that an image is formed.

When the first developer conveying section 202 and the second developer conveying section 203 rotate as mentioned above, the first gear 202*c* of the first developer conveying section 202 and the second gear 203*c* of the second developer conveying section 203 seek to move away from the driving gear 101 respectively. However, since the deflection suppression belt 211 is stretched out by the first temperature rise suppression section 209 fixed to the end part of the first rotation shaft member 202*a* of the first developer conveying section 202 and the second temperature rise suppression section 210 fixed to the end part of the second rotation shaft member 203*a* of the second developer conveying section 203, deflection of the first rotation shaft member 202*a* and the second rotation shaft member 203*a* is suppressed. Furthermore, since the first temperature rise suppression section 209 and the second temperature rise suppression section 210 have a higher thermal conductivity than those of the first rotation shaft member 202*a* and the second rotation shaft member 203*a* as well as the first bearings 212*a* and 212*b* and the second bearings 213*a* and 213*b*, heat in vicinities of the first bearings 212*a* and 212*b* and the second bearings 213*a* and 213*b* moves to the first temperature rise suppression section 209 and the second temperature rise suppression section 210.

Accordingly, in the developing apparatus 200, generation of great frictional heat due to uneven abrasion of the first rotation shaft member 202*a* and the second rotation shaft member 203*a* is suppressed, and heat generated in the vicinities of the first bearings 212*a* and 212*b* and the second bearings 213*a* and 213*b* is speedily radiated outside via the first temperature rise suppression section 209 and the second temperature rise suppression section 210. Therefore, even when the first developer conveying section 202 and the second developer conveying section 203 which have the first rotation shaft member 202*a* and the second rotation shaft member 203*a* which are made of a resin are provided, it is possible to prevent fusion and adhesion of a toner in the vicinities of the first bearings 212*a* and 212*b* and the second bearings 213*a* and 213*b* which result from friction of the first rotation shaft member 202*a* and the second rotation shaft member 203*a* and the first bearings 212*a* and 212*b* and the second bearings 213*a* and 213*b*. Note that, in the developing apparatus 200, in the both end parts of the axial direction of the first rotation shaft member 202*a* and the both end parts of the axial direction of the second rotation shaft member 203*a*, the first temperature rise suppression section 209 and the second temperature rise suppression section 210 are provided and the deflection suppression belt 211 is stretched out, but the developing apparatus may be configured so that the first temperature rise suppression section 209 is provided only in the one end part in a side of the first gear 202*c* of the first rotation shaft member 202*a*, the second temperature rise suppression section 210 is provided only in the one end part in a side of the second gear 203*c* of the second rotation shaft member 203*a*, and the other end part of the first rotation shaft member 202*a* and the other end part of the second rotation shaft member 203*a* are directly supported by bearings fixed to the developing tank 201 as conventional.

In the developing apparatus 200, the deflection suppression belt 211 has a higher thermal conductivity than those of the first temperature rise suppression section 209 and the second temperature rise suppression section 210. Accordingly, heat which has moved to the first temperature rise suppression section 209 and the second temperature rise suppression section 210 moves to the deflection suppression belt 211. Therefore, it is possible to perform heat radiation by the deflection suppression belt 211 which is stretched out by the first temperature rise suppression section 209 and the second temperature rise suppression section 210, resulting in that it is possible to more surely prevent fusion and adhesion of a toner in the vicinities of the first bearings 212*a* and 212*b* and the second bearings 213*a* and 213*b*.

Moreover, in the developing apparatus 200, the deflection suppression belt 211 is provided with the fins 2112 on the outer peripheral surface of the belt main body 2111. Therefore, it is possible to increase a surface area of the deflection suppression belt 211, so that it is possible to more efficiently perform heat radiation by the deflection suppression belt 211.

Moreover, in the developing apparatus 200, the first temperature rise suppression section 209 and the second temperature rise suppression section 210 have the disk-shaped projections 2092*a*, 2092*b*, 2102*a* and 2102*b*. Since positional displacement of the deflection suppression belt 211 is suppressed by the disk-shaped projections 2092*a*, 2092*b*, 2102*a* and 2102*b*, it is possible to suppress deflection of the first rotation shaft member 202*a* and the second rotation shaft member 203*a* more surely.

Since the image forming apparatus 100 provided with the developing apparatus 200 described above is able to prevent fusion and adhesion of a toner in the vicinities of the first bearings 212*a* and 212*b* and the second bearings 213*a* and 213*b*, it is possible to prevent deterioration of a stirring property and a conveying property of the toner circularly conveyed by the first developer conveying section 202 and the second developer conveying section 203, making it possible to stably form a good image.

Figure 8:
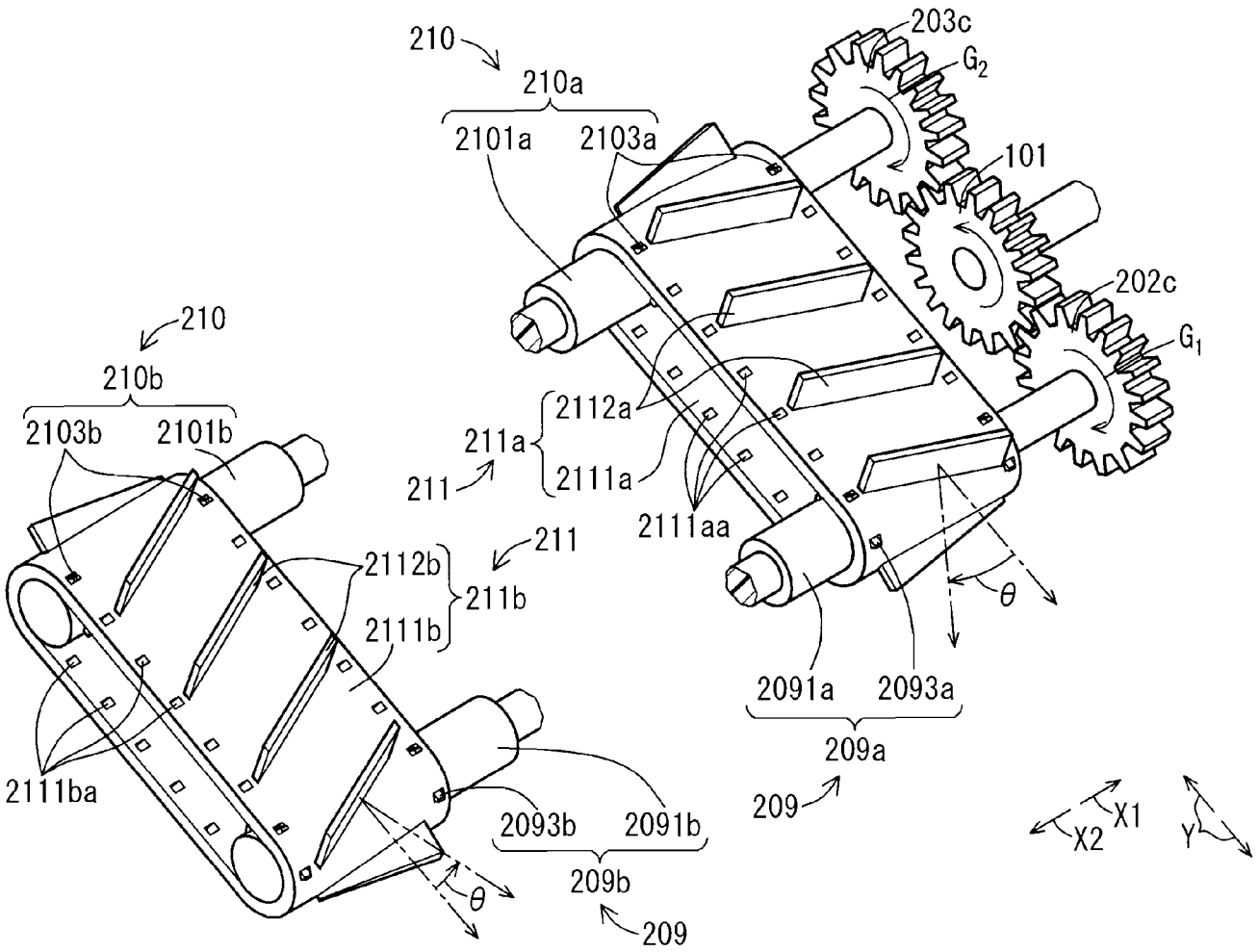
FIG. 8 is a perspective view of the first temperature rise suppression section 209 and the second temperature rise suppression section 210 as well as the deflection suppression belt 211 according to a modified embodiment.

Next, description will be given for a modified embodiment of the developing apparatus 200. In the modified embodiment, a configuration of the developing apparatus 200 other than the first temperature rise suppression section 209 and the second temperature rise suppression section 210 as well as the deflection suppression belt 211 is the same as that of the embodiment described above. FIG. 8 is a perspective view of the first temperature rise suppression section 209 and the second temperature rise suppression section 210 as well as the deflection suppression belt 211 according to the modified embodiment, which corresponds to FIG. 6. Description below is all for the modified embodiment.

As shown in FIG. 8, the first temperature rise suppression section 209*a* according to the modified embodiment has a plurality of pawl-shaped projections 2093*a* instead of the disk-shaped projections 2092*a*. The plurality of pawl-shaped projections 2093*a* project from the side surface of the first rotary cylinder 2091*a* so as to have equal intervals in a circumferential direction of the first rotary cylinder 2091*a* in two positions in an axial direction of the first rotary cylinder 2091*a*. When the first rotation shaft member 202*a* rotates about the axis, the first rotary cylinder 2091*a* and the plurality of pawl-shaped projections 2093*a* provided in the first rotary cylinder 2091*a* also rotate about the axis. Moreover, the first temperature rise suppression section 209*b* according to the modified embodiment has a plurality of pawl-shaped projections 2093*b* instead of the disk-shaped projections 2092*b*. The plurality of pawl-shaped projections 2093*b* project from the side surface of the first rotary cylinder 2091*b* so as to have equal intervals in a circumferential direction of the first rotary cylinder 2091*b* in two positions in an axial direction of the first rotary cylinder 2091*b*. When the first rotation shaft member 202*a* rotates about the axis, the first rotary cylinder 2091*b* and the plurality of pawl-shaped projections 2093*b* provided in the first rotary cylinder 2091*b* also rotate about the axis. In addition, the second temperature rise suppression section 210*a* according to the modified embodiment has a plurality of pawl-shaped projections 2103*a* instead of the disk-shaped projections 2102*a*. The plurality of pawl-shaped projections 2103*a* project from the side surface of the second rotary cylinder 2101*a* so as to have equal intervals in a circumferential direction of the second rotary cylinder 2101*a* in two positions in an axial direction of the second rotary cylinder 2101*a*. When the second rotation shaft member 203*a* rotates about the axis, the second rotary cylinder 2101*a* and the plurality of pawl-shaped projections 2103*a* provided in the second rotary cylinder 2101*a* also rotate about the axis. Furthermore, the second temperature rise suppression section 210*b* according to the modified embodiment has a plurality of pawl-shaped projections 2103*b* instead of the disk-shaped projections 2102*b*. The plurality of pawl-shaped projections 2103*b* project from the side surface of the second rotary cylinder 2101*b* so as to have equal intervals in a circumferential direction of the second rotary cylinder 2101*b* in two positions in an axial direction of the second rotary cylinder 2101*b*. When the second rotation shaft member 203*a* rotates about the axis, the second rotary cylinder 2101*b* and the plurality of pawl-shaped projections 2103*b* provided in the second rotary cylinder 2101*b* also rotate about the axis.

As shown in FIG. 8, in the belt main body 2111*a* according to the modified embodiment, holes 2111*aa* are formed so as to have equal intervals in a longitudinal direction in two positions in the width direction. The intervals with which the holes 2111*aa* are formed are the same as the intervals with which the pawl-shaped projections 2093*a* and 2103*a* are provided. Moreover, in the belt main body 2111*b* according to the modified embodiment, holes 2111*ba* are formed so as to have equal intervals in a longitudinal direction in two positions in the width direction. The intervals with which the holes 2111*ba* are formed are the same as the intervals with which the pawl-shaped projections 2093*b* and 2103*b* are provided.

In the belt main body 2111*a*, the pawl-shaped projections 2093*a* are inserted into the holes 2111*aa* which are formed in a part abutting the first rotary cylinder 2091*a*, and the pawl-shaped projections 2103*a* are inserted into the holes 2111*aa* which are formed in a part abutting the second rotary cylinder 2101*a*. Moreover, in the belt main body 2111*b*, the pawl-shaped projections 2093*b* are inserted into the holes 2111*ba* which are formed in a part abutting the first rotary cylinder 2091*b*, and the pawl-shaped projections 2103*b* are inserted into the holes 2111*ba* which are formed in a part abutting the second rotary cylinder 2101*b*. Accordingly, when the first rotation shaft member 202*a* and the second rotation shaft member 203*a* rotate and, as a result thereof, the pawl-shaped projections 2093*a*, 2093*b*, 2103*a* and 2103*b* rotate, the belt main bodies 2111*a* and 2111*b* are to be traveled and driven in the longitudinal direction while positional displacement of the belt main bodies 2111*a* and 2111*b* is suppressed. Thereby, heat accumulation around the fins 2112*a* and 2112*b* provided on the outer peripheral surfaces of the belt main bodies 2111*a* and 2111*b* is suppressed, so that it becomes easy to cool the first bearings 212*a* and 212*b* and the second bearings 213*a* and 213*b* as well as the first rotation shaft member 202*a* and the second rotation shaft member 203*a*.

As shown in FIG. 8, in order to generate an air flow toward the developing tank 201, the fins 2112*a* and 2112*b* are provided so that normal directions of main surfaces thereof have an angle θ which is more than 0° and less than 90° with respect to the longitudinal directions of the belt main bodies 2111*a* and 2111*b*. Accordingly, when the belt main bodies 2111*a* and 2111*b* are traveled and driven in the longitudinal direction, it is possible to fan the developing tank 201 by the fins 2112*a* and 2112*b*, so that it becomes easier to cool the vicinities of the first bearings 212*a* and 212*b* and the second bearings 213*a* and 213*b*. Note that, it is preferable that the fins 2112*a* and 2112*b* have a thinner thickness in order to be elastically deformable when the belt main bodies 2111*a* and 2111*b* are traveled and driven in the longitudinal direction.

According to such a modified embodiment, it becomes possible to efficiently cool the vicinities of the first bearings 212*a* and 212*b* and the second bearings 213*a* and 213*b*, so that it becomes possible to prevent fusion and adhesion of a toner more surely. Note that, also in this modified embodiment, the deflection suppression belt 211 may be provided only in each one end part of the first rotation shaft member 202*a* and the second rotation shaft member 203*a* as described above.

The invention may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

REFERENCE SIGNS LIST

20: Toner image forming section
30: Transfer section
40: Fixing section
50: Recording medium supply section
60: Discharge section
100: Image forming apparatus
101: Driving gear
200, 200*b*, 200*c*, 200*m*, 200*y*: Developing apparatus
201: Developing tank
202: First developer conveying section
202*a*: First rotation shaft member
202*b*: First spiral blade
202*c*: First gear
203: Second developer conveying section
203*a*: Second rotation shaft member
203*b*: Second spiral blade
203*c*: Second gear
204: Developing roller
205: Developing tank cover
207: Partition wall
209, 209*a*, 209*b*: First temperature rise suppression section
210, 210*a*, 210*b*: Second temperature rise suppression section
211, 211*a*, 211*b*: Deflection suppression belt
212*a*, 212*b*: First bearing
213*a*, 213*b*: Second bearing
250, 250*b*, 250*c*, 250*m*, 250*y*: Toner supply pipe
300, 300*b*, 300*c*, 300*m*, 300*y*: Toner cartridge
2092*a*, 2092*b*, 2102*a*, 2102*b*: Disk-shaped projection
2093*a*, 2093*b*, 2103*a*, 2103*b*: Pawl-shaped projection
2112, 2112*a*, 2112*b*: Fin

The invention claimed is:

1. A developing apparatus which develops an electrostatic latent image formed on an image bearing member, comprising:

a developing tank having a wall part, the wall part defining an internal space for containing developer;

a plurality of developer conveying sections which are provided inside the developing tank and respectively have a rotation shaft member and a spiral blade fixed to the rotation shaft member which are made of a resin, the plurality of developer conveying sections respectively conveying developer contained inside the developing tank by rotating about an axis of the rotation shaft member;

a plurality of bearings which are provided in the wall part and respectively correspond to the plurality of developer conveying sections;

a plurality of temperature rise suppression sections which have a higher thermal conductivity than those of the rotation shaft members and the bearings, and respectively correspond to the plurality of developer conveying sections and the plurality of bearings, the plurality of temperature rise suppression sections being configured in a cylindrical shape, the respective rotation shaft members being inserted in the plurality of temperature rise suppression sections corresponding thereto, one part of each of the plurality of temperature rise suppression sections being interposed between the rotation shaft member corresponding thereto and the bearing corresponding thereto, and another part of each of the plurality of temperature rise suppression sections being disposed in a space outside the developing tank; and a deflection suppression belt being stretched out by the another part of each of the plurality of temperature rise suppression sections.

2. The developing apparatus according to claim 1, wherein the deflection suppression belt has a fin.

3. The developing apparatus according to claim 1, wherein the temperature rise suppression sections have a projection for suppressing positional displacement of the deflection suppression belt.

4. An image forming apparatus of an electrophotographic type, comprising:

the developing apparatus according to claim 1.

5. The developing apparatus according to claim 2, wherein the temperature rise suppression sections have a projection for suppressing positional displacement of the deflection suppression belt.

* * * * *